United States Patent [19]

Simington

[11] Patent Number: 4,592,191

[45] Date of Patent: Jun. 3, 1986

[54] AUTOMATIC SKIN PACKAGING APPARATUS

[75] Inventor: George Simington, Piscataway, N.J.

[73] Assignee: Simanex Inc., Piscataway, N.J.

[21] Appl. No.: 442,285

[22] Filed: Nov. 17, 1982

[51] Int. Cl.[4] ..... B65B 11/52

[52] U.S. Cl. ..... 53/509; 53/282

[58] Field of Search ..... 53/282, 329, 427, 509; 74/120, 121, 577 R; 198/859

[56] References Cited

U.S. PATENT DOCUMENTS

| | | | |
|---|---|---|---|
| 3,342,010 | 9/1967 | Henry | 53/282 |
| 3,491,504 | 1/1970 | Young et al. | 53/509 |
| 3,534,524 | 10/1970 | Swezey | 53/509 |
| 3,587,200 | 6/1971 | Stone | 53/509 |
| 3,691,859 | 9/1972 | Peters | 74/120 |
| 3,860,108 | 1/1975 | Farfaglia | 198/859 |
| 3,977,156 | 8/1976 | Rorer | 53/511 |
| 4,034,536 | 6/1977 | Mahaffy et al. | 53/427 |
| 4,064,676 | 12/1977 | King et al. | 53/77 |

*Primary Examiner*—James F. Coan

*Attorney, Agent, or Firm*—James J. Romano, Jr.

[57] ABSTRACT

Automatic skin packaging apparatus are provided and comprise concomitantly operable substrate feeder means, film heater means, film pressure forming means, film cooling means, film and substrate die cutting means, and skin packaged article-substrate finishing and collection means. Conveyor and film supply means are intermittently operable, from constantly operable drive motor means, to intermittently advance article-bearing substrates to the above specified components, in turn, and to intermittently supply film thereover at said film heater means. Stop means insure precise conveyor means operation, and interrelated control means are provided to precisely control the time and duration of operation of all apparatus components.

17 Claims, 7 Drawing Figures

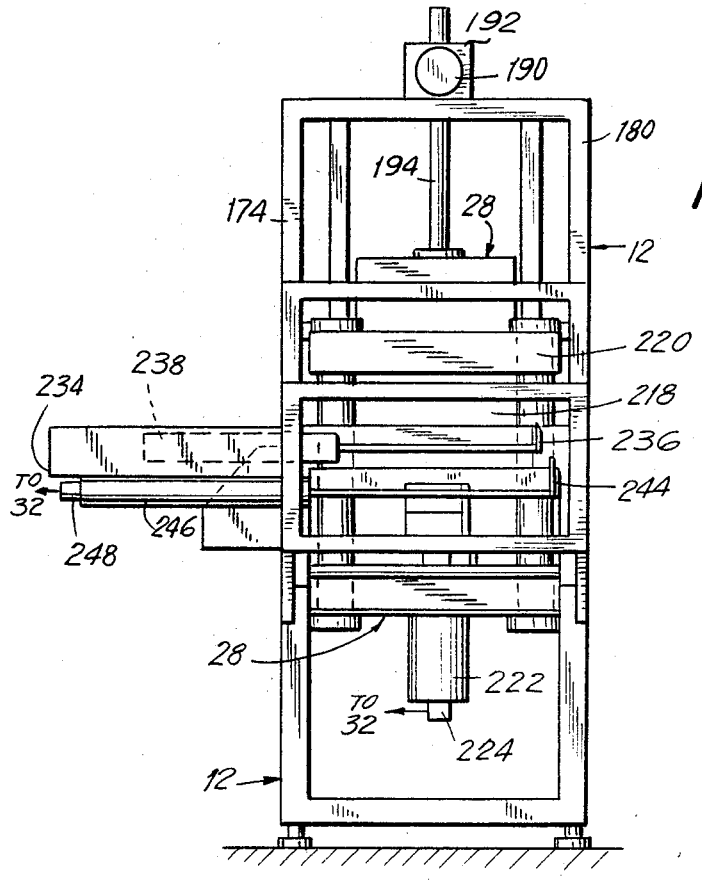
FIG. 3
FIG. 7
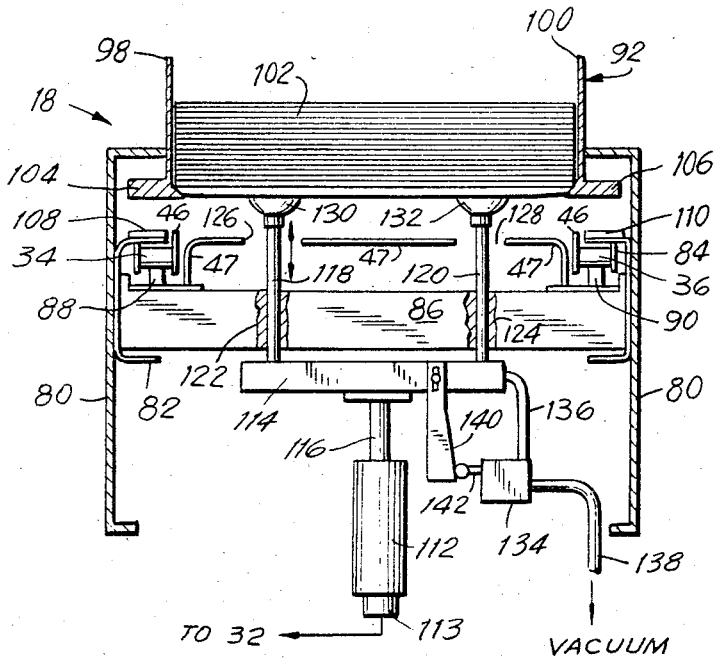

AUTOMATIC SKIN PACKAGING APPARATUS

BACKGROUND OF THE INVENTION

1. Field of the Invention

This invention relates to new and improved apparatus for the automatic packaging of articles and, more particularly, to such apparatus as are effective for the automatic skin packaging of articles on porous substrates through use of an appropriately thermoplastic packaging film and vacuum film forming and bonding means.

2. Description of the Prior Art

Although a wide variety of skin packaging apparatus are known in the prior art, none are known to applicant which can accomplish this function with the particularly advantageous combination of high effective article packaging rates, relatively simple and economical apparatus design and construction, low apparatus maintenance requirements, maximal apparatus operator safety provisions, and ready and precise adjustability in apparatus packaging rate, respectively, as is provided by the new and improved apparatus of this invention. More specifically, the most relevant prior art known to applicant is that disclosed in U.S. Pat. No. 3,377,770 to Rorer, U.S. Pat. No. 3,587,200 to Stone, U.S. Pat. No. 3,668,820 to Parvin, U.S. Pat. No. 3,673,760 to Canamero, U.S. Pat. No. 3,701,229 to Zelnick, U.S. Pat. No. 3,902,302 to Tartarini, U.S. Pat. No. 3,930,350 to Reid, U.S. Pat. No. 3,958,394 to Mahaffy et al, U.S. Pat. No. 3,977,156 to Rorer, and U.S. Pat. No. 4,064,676 to King et al, respectively, all of which relate to the automatic skin packaging of articles. In each instance, however, the automatic skin packaging apparatus of these disclosures will readily be seen to be configured and operable in whole or in part in manners significantly different than those embodied by the teachings of this invention, and to accordingly be incapable of providing the significant combination of advantages specified hereinabove.

OBJECTS OF THE INVENTION

It is, accordingly, an object of this invention to provide new and improved automatic skin packaging apparatus which are operable at maximal effective article packaging rates commensurate with the capabilities of the apparatus operator(s).

Another object of this invention is the provision of apparatus as above which are operable to skin package a series of articles in constantly precise and consistently highly satisfactory manner.

Another object of this invention is the provision of apparatus as above which are of relatively simple and economical design and construction.

Another object of this invention is the provision of apparatus as above which require relatively little maintenance.

Another object of this invention is the provision of apparatus as above wherein maximal provision is made for operator safety.

A further object of this invention is the provision of apparatus as above incorporating readily and precisely adjustable apparatus control means, whereby the article packaging rate of the apparatus may be readily and precisely adjusted to appropriately meet a wide variety of article packaging requirements.

SUMMARY OF THE INVENTION

As disclosed herein, the new and improved automatic skin packaging apparatus of my invention comprises concomitantly operable substrate feeder means, film heater means, film pressure forming means, film cooling means, film and substrate die cutting means, and skin packaged article-substrate finishing and collecting means, respectively. Substrate conveyor means and film supply means are driven, from constantly operable drive motor means through crank, rack, pinion and overrunning clutch connecting means, to intermittently advance article-bearing substrates precisely in turn to each of the above-specified components, and to concomitantly supply and advance the film over the article-bearing substrates immediately prior to the advancement of the same to the film pressure forming means, respectively. Stop means are provided to stop the conveyor means at precisely the same location after each intermittent advancement thereof, and slip clutch means prevent damage to the conveyor and connecting means attendant the operation of the stop means. Readily and precisely adjustable control switch means are provided to enable like adjustment in the time and duration of operation of each of the substrate feeder, pressure forming, die cutting, and finishing and collecting means, respectively; while precisely adjustable, and closely interrelated, control over both the rate and duration of operation of the conveyor and film supply and feeder means is provided through variation in the speed of the drive motor means and an operatively associated control console.

DESCRIPTION OF THE DRAWINGS

The above and other objects and significant advantages of my invention are believed made clear by the following detailed description thereof taken in conjunction with the accompanying drawings wherein;

FIG. 3 is an end elevational view of the output end of the apparatus of FIG. 1;

FIG. 7 is a cross sectional view taken generally along line 7—7 in FIG. 1.

DETAILED DESCRIPTION OF A PREFERRED EMBODIMENT

Figure 1:
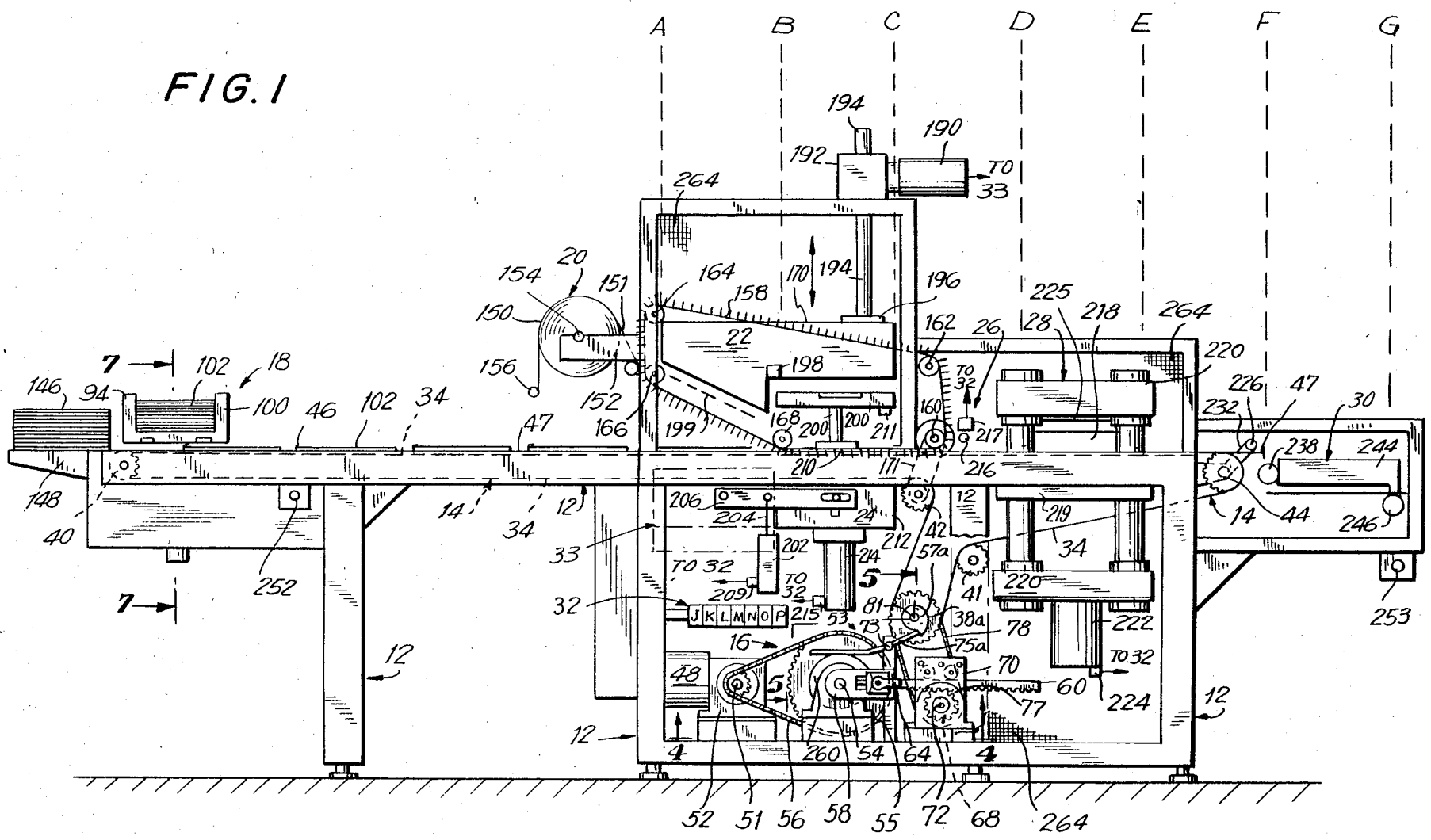
FIG. 1 is a side elevational view of new and improved packaging apparatus constructed and operative in accordance with the teachings of my invention.

Referring now to FIG. 1 of the drawings, new and improved skin packaging apparatus constructed and operative in accordance with the teachings of my invention are indicated generally at 10; and comprise a generally elongate, main support frame 12 upon which are respectively operatively disposed main conveyor means 14, variable speed conveyor drive means 16, automatic substrate feeder means 18, film supply and feeder means 20, film heater means 22, film pressure forming means 24, film cooling means 26, film and substrate die cutting means 28, skin packaged article finishing and collection means 30, main apparatus timing control switch means 32, and apparatus control console means 33, respectively.

Figure 2:
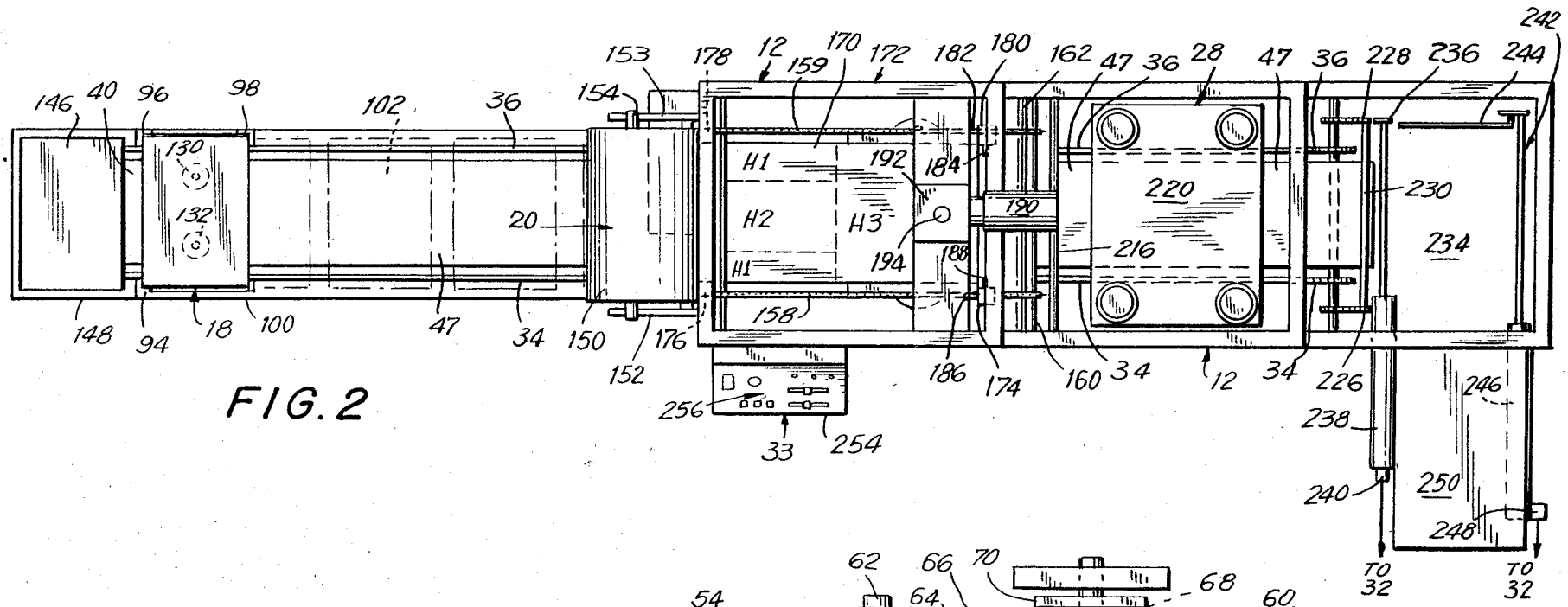
FIG. 2 is a top elevational view of the apparatus of FIG. 1.
Figure 5:
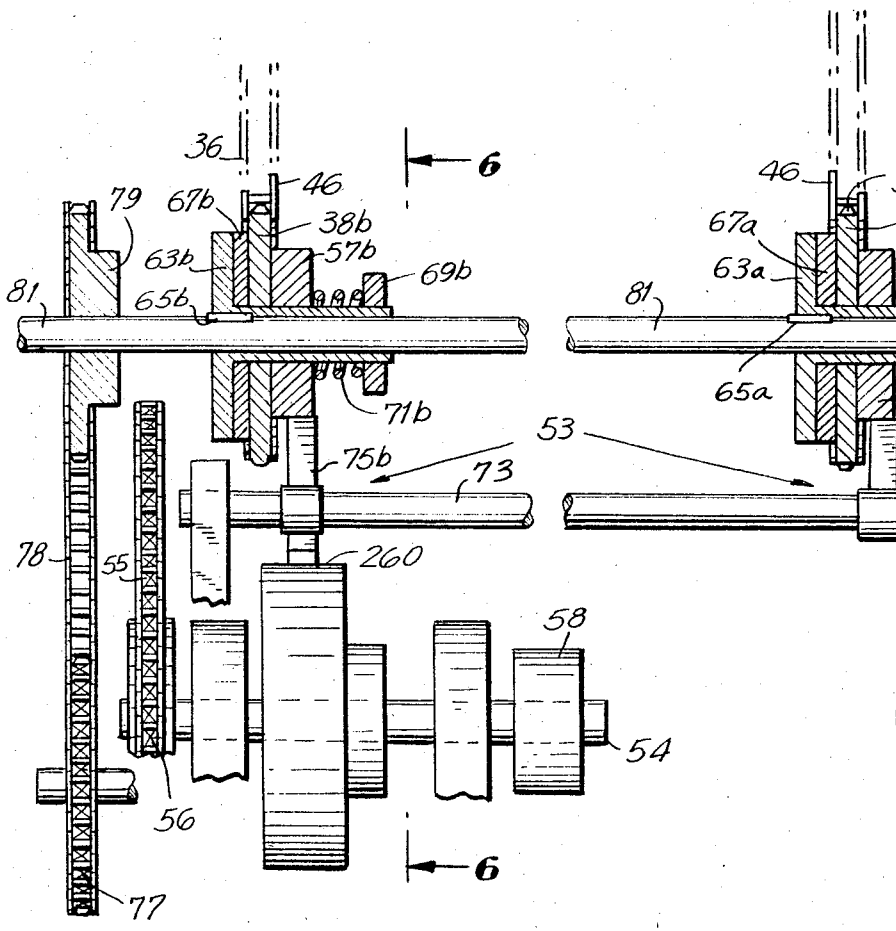
FIG. 5 is a fragmentary end view taken generally along line 5—5 of FIG. 1.

As best seen in FIGS. 1, 2 and 5, the conveyor means 14 comprise spaced, generally parallel endless conveyor roller chains 34 and 36 which respectively extend around and between longitudinally aligned ones of a spaced pair of main conveyor drive sprockets 38*a* and 38*b* (FIG. 5) and similarly spaced pairs of idler sprockets 40, 41, 42 and 44, all as supported for rotation from the main frame 12 by appropriate shaft means as described hereinbelow. The conveyor chains 34 and 36 comprise generally aligned, hooked pusher lugs 46 which extend therefrom, and which are respectively spaced by a distance equal to each incremental movement of the conveyor drive means 16 as described in greater detail hereinbelow. This distance may, for example, be equal to approximately 12½ inches. A conveyor surface platen is indicated at 47 and extends between conveyor roller chains 34 and 36 substantially from idler sprockets 40 to idler sprockets 44 except in the areas of the film pressure forming means 24 and the film and substrate die cutting means 28, respectively.

Figure 4:
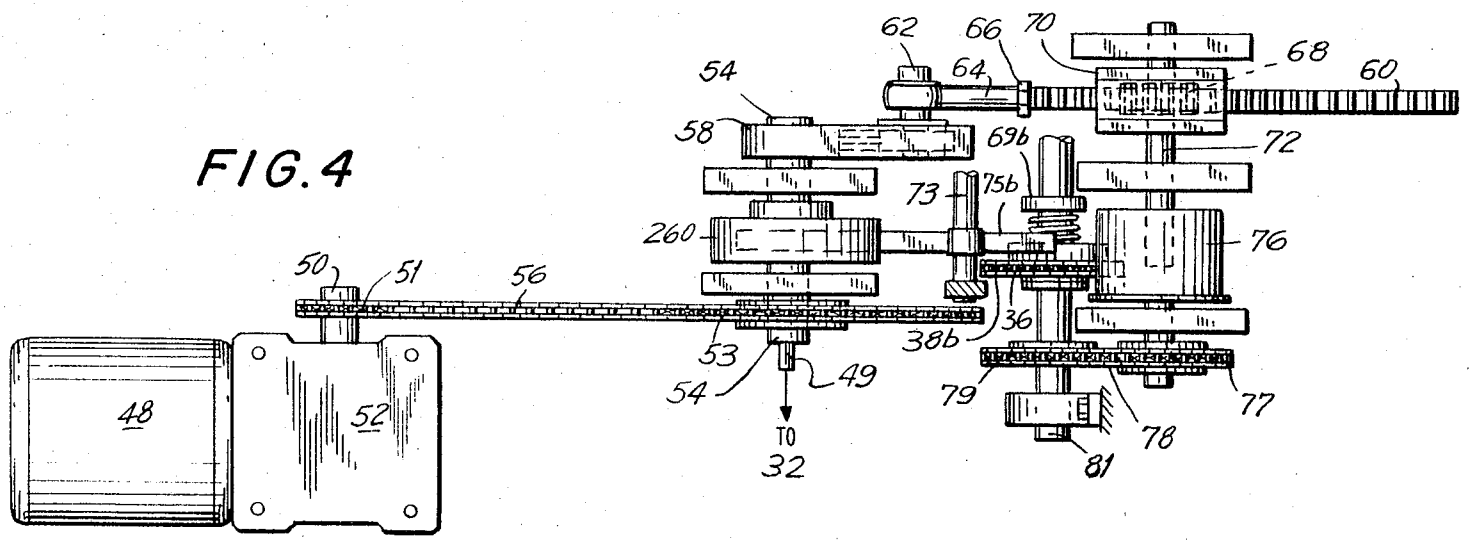
FIG. 4 is a fragmentary plan view taken generally along line 4—4 in FIG. 1.

As best seen in FIGS. 1, 4 and 5, the conveyor drive means 16 comprise a variable speed electric drive motor 48 which is supported from main frame 12, and is operable to drive a drive shaft 50 and connected drive sprocket 51 through an appropriate gear reduction box 52. Drive motor 48 is controlled from control console means 33. An intermediate shaft and connected intermediate or reduction drive sprocket are indicated at 54 and 55 with the former supported for rotation from main frame 12. A drive chain 56 (FIG. 1) drivingly connects sprockets 51 and 55 for the driven rotation of the latter by the former with substantial torque multiplication, thus advantageously making possible the use of a relatively small dc drive motor 48. A flexible cable 49 (FIG. 4) connects shaft 54 as indicated to main apparatus timing control switch means 32 to provide timing information regarding rotational speed of motor 48 to the switch means.

A crank is indicated at 58 and is carried from shaft 54 for rotation therewith. A rack gear is indicated at 60, and is operatively connected as shown to crank 58 through shaft 62, a relatively rotatable bearing connection 64, and an adjustable, screw threaded connector 66, respectively. A pinion gear is indicated at 68 and is maintained as shown in driven relationship with rack gear 60 by a rack housing and bearing slide 70 which is in turn supported from main frame 12.

A drive shaft 72 is rotated by pinion gear 68 to in turn rotate an overrunning cam clutch 76 which is configured to rotate a connected intermediate drive sprocket 77 therethrough only in the clockwise direction as seen in FIG. 1, and to simply be overrun by drive shaft 72 in the other direction. Thus, although pinion gear 68 makes two complete revolutions, i.e. one in each direction, for every revolution of sprocket 55, clutch 76 insures that drive sprocket 77 revolves only once for each such revolution of drive sprocket 55; and, that when so rotated, drive sprocket 77 will accelerate smoothly from rest to maximal rotational velocity during the first 180° of its rotation, and will then smoothly decelerate back to rest attendant the following 180° of its rotation. Drive sprocket will then remain at rest or dwell during the immediately following oppositely directed rotation of pinion gear 68. A drive chain 78 rotates a driven sprocket 79 of the conveyor means 14 from sprocket 77. FIG. 5 makes clear that driven rotation of sprocket 77 is in turn effective, through conveyor drive sprockets shaft 81, to drive the main conveyor drive sprockets 38*a* and 38*b*, and thus the conveyor means 14, at the same rate since sprockets 77 and 79 are of the same size. Thus is made clear that the constant speed rotation of drive motor 48 is translated into precisely synchronized, intermittent drive of the conveyor means 14; thereby advantageously eliminating the need for repeated starting and stopping of the drive motor 48, with attendant requirement for conveyor means-positional or like sensing devices and/or drive motor timing and control circuitry, to achieve precise intermittent conveyor means advancement.

This smooth, albeit intermittent, driven rotation of the drive sprocket 77, and like drive of the conveyor means 14 is of particularly significant advantage regarding the ease of accurate placement of articles on the substrates, and the maintenance of those articles as placed, without jarring or the like, as the respective article-substrate combinations are conveyed through the apparatus 10 for packaging, all as described in greater detail hereinbelow. If desired, motor brake or like delay means, not shown, may be incorporated with the drive motor 48 and controlled from the control console means 33 to increase the dwell period of the sprocket 77, and thus of the conveyor means 14, thereby allowing the apparatus operator even more dwell time for the accurate placement, for example, of intricate and/or multiplicities of articles on each of the substrates.

Figure 6:
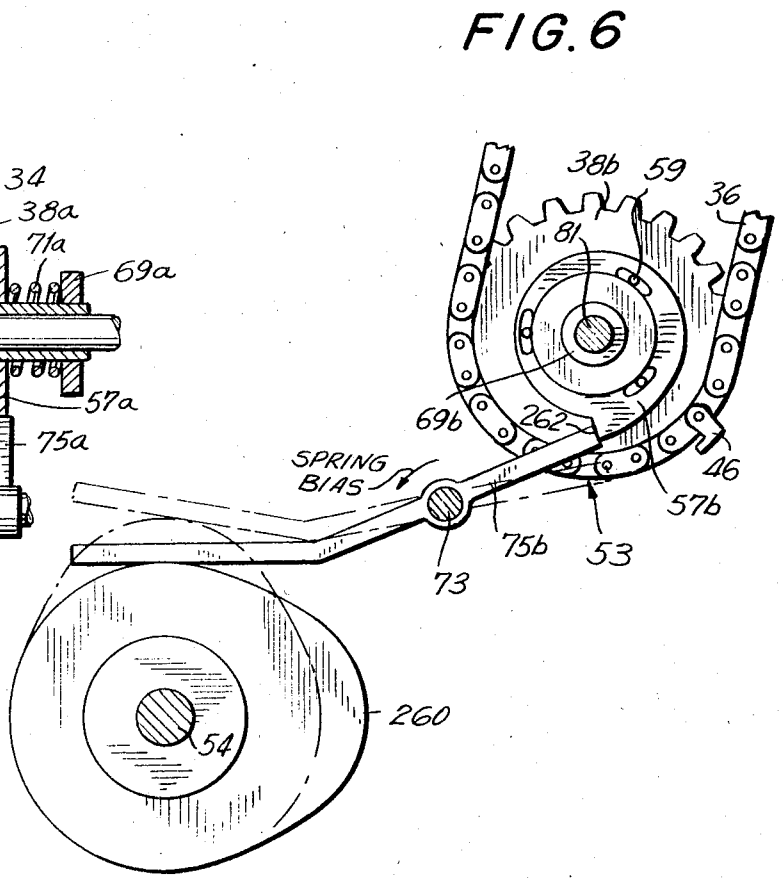
FIG. 6 is a view taken generally along line 6—6 in FIG. 5.

Further included in the conveyor drive means 14 are incremental rotation control means, as generally indicated at 53 in FIGS. 1, 5 and 6, and which comprise arcuately slotted stop plates 57*a* and 57*b* which are respectively adjustably secured as shown by mounting screws 59 (FIG. 6) to each of the main conveyor drive sprockets 38*a* and 38*b*. Slip clutches 61*a* and 61*b* (FIG. 5) are respectively operatively associated with the main conveyor drive sprockets 38*a* and 38*b*, and comprise hubbed mounting sleeves 63*a* and 63*b* which are slidably mounted on conveyor drive shaft 81 for rotation therewith by keys 65*a* and 65*b*. Friction plates 67*a* and 67*b* are respectively disposed as shown between the mounting sleeve hubs and the main conveyor drive sprockets. Tension nuts 69*a* and 69*b* are respectively threadably secured to the mounting sleeves 63*a* and 63*b* and operate to adjustably compress springs 71*a* and 71*b* against stops 57*a* and 57*b* to in turn compress friction plates 67*a* and 67*b* between the respective mounting sleeve hubs and main conveyor drive sprockets 38*a* and 38*b* thus determining, in each instance, the magnitude of the conveyor driving torque which can be transmitted, before slippage occurs, between conveyor drive shaft 81 and the main conveyor drive sprockets. A pawl pivot shaft 73 is supported for rotation from main frame 12; and spaced, spring loaded pawls 75*a* and 75*b* are carried from shaft 73 to respectively cooperate as shown with stop plates 57*a* and 57*b*. A pawl actuating cam 260 is carried from intermediate shaft 54 and cooperates with a tang on pawl 75*b* to move the latter against the spring bias to the disengaged, dashed line position thereof of FIG. 6 clear of stop plate 57*b* once for every revolution of the intermediate shaft 54 which, as described hereinabove, is rotated continuously by drive motor 48. The depicted configuration of cam 260 is such once pawl 75*b* has cleared the stop plate 57*b* the former is shortly thereafter returned by the spring bias to simply ride against the smooth periphery of the stop. Pawl 75*a* which is joined to the common pawl shaft 73 operates concomitantly relative to stop 57*a* in the same manner described for pawl 75*b* relative to stop 57*b*.

Pawl actuating cam 260 is oriented on shaft 54 relative to sprocket 55, and thus relative to sprocket 77 on overrunning clutch 76, so that the cam will be effective to disengage pawls 75*a* and 75*b* from stop plates 57*a* and 57*b* just prior to the end of each dwell period of the conveyor drive means, and to retain the pawls so disengaged to free the stop plates 57*a* and 57*b*, and accordingly the conveyor drive sprockets 38*a* and 38*b*, for the beginning of the next conveyor drive means advancement. As this occurs, the pawls are then released by cam 260 to simply ride against the smooth peripheries of the stop plates while the latter rotate in unison with the conveyor drive sprockets. As the conveyor drive sprockets 38*a* and 38*b* complete one revolution, which results in one incremental advance of the conveyor chains 34 and 36 as described hereinabove, the respective pawls and stop plates will again come to the respective positions thereof of FIG. 6 wherein the pawls will be effective to abut the stop plate edges, as shown at 262 on stop plate 57*b* in FIG. 6, to positively halt the rotation of the respective stop plates, and thus the conveyor drive sprockets 38*a* and 38*b*, in precisely the same positions at the end of each advance. The slip clutches 61*a* and 61*b* will slip as necessary to enable this positive and precise halting of the conveyor drive sprockets without damage to any of the conveyor drive means components. As a result, any positional error in the operation of the conveyor drive means 16 is automatically corrected for, thus insuring precise and constant registration of each substroke as the same is advanced through the apparatus 10, all to particularly significant advantage as will readily be clear to those skilled in this art. Of additional advantage is the fact that, should the apparatus 10 jam for any reason, the slip clutches 61*a* and 61*b* will enable conveyor drive sprockets 38*a* and 38*b* to simply slip relative to shaft 81, thus preventing damage to the apparatus 10, and providing for easy readjustment of the conveyor chains 34 and 36 upon clearing of the jam to minimize apparatus downtime.

As best seen in FIGS. 1, 2 and 7, the automatic substrate feeder means 18 comprise a housing 80 which is supported from the main frame 12, and conveyor channel supports 82 and 84 and a conveyor brace 86 which are supported in turn as shown from the housing 80. Conveyor chain guides and supports 88 and 90 extend upwardly as shown from brace 86 for obvious purpose. A substrate holder frame 92 comprises four spaced angle posts 94, 96, 98 and 100 ( FIG. 2) which are carried from the housing 80 and which hold a stack of porous board or like substrates 102. Spring steel laminated leaf springs as indicated at 104 and 106 are adjustably oriented as shown at the bottom of the holder frame 92 and are operable to contain and control the substrates 102 so that only one substrate will be released at a time upon demand.

The conveyor platen 47 is supported as shown from the conveyor brace 86; and substrate guides 108 and 110 are carried from the respective conveyor channel supports 82 and 84 and cooperate as shown with the respective conveyor roller chains 34 and 36 by entrapping the substrates therebetween atop the conveyor platen 47.

A pneumatic actuating cylinder is indicated at 112 and is supported in any suitable manner, not shown, from the main support frame 12. The actuating cylinder 112 is controlled as indicated by solenoid operated value means as schematically indicated at 113 from the main control switch means 32. A vertically movable vacuum manifold and support bracket is indicated at 114 and is carried as shown from the piston rod 116 of pneumatic cylinder 112. Spaced suction guide tubes 118 and 120 extend upwardly from manifold 114 through guide bearings 122 and 124 in conveyor brace 86, and aligned apertures 126 and 128 in conveyor plates 47, respectively, and terminated as shown in suction cups 130 and 132.

A mechanically operable vacuum control valve is indicated at 134 and connects manifold 114 as shown to a source of constant vacuum through flexible vacuum conduits 136 and 138. A cam 140 is carried from the manifold 114 and cooperates as shown with valve actuator 142 to operate valve 134. Upon operation of actuating cylinder 112 to move piston rod 116 from the retracted to the depicted, extended position thereof, it may be understood that corresponding upward movement of the manifold-carried cam 140 will be effective to connect valve 134 to vacuum and create suction at the suction cups 130 and 132 which will thus be effective to adhere to the substrate 102 at the bottom of the stack. Accordingly, that substrate will be pulled from the bottom of the stack by the suction cups against the action of leaf springs 104 and 106 and deposited atop the conveyor platen 47 between guides 108 and 110 for grasping by lugs 46 upon retraction of the actuating cylinder rod 116. This retraction is also effective, through cam 140 and valve actuator 142 to connect valve 134 to atmosphere, thus breaking the suction in the suction cups 130 and 132 and freeing the substrate for conveyance upon the next movement of conveyor means 14. An additional supply 146 of substrates 102 is conveniently disposed as shown on support bracket 148 adjacent automatic feeder 18 for insertion into the latter by the operator as and when needed. The automatic substrate feeder 18 advantageously insures that the substrates are each accurately placed in turn on the conveyor means 14, and allows the apparatus operator to spend all of his or her time in concentrating on the proper placement of the articles to be packaged on the substrates. This latter feature can, in instances of higher speed apparatus operation, advantageously result in the elimination of the need for an additional operator.

The film supply and feeder means 20 comprise a roll 150 of an appropriate thermoplastic film 151 which is supported for rotation as shown from main frame 12 by brackets 152 and 153 and shaft 154. A tension control weight 156 cooperates as shown with roll 150 to maintain proper film tension. Two spiked, endless film feed chains 158 and 159, spaced by substantially the width of the film roll 150, extend as shown around a chain drive sprocket 160, and idler sprockets 162, 164, 166 and 168, respectively, each of which is supported for rotation from main frame 12. The chain drive sprocket 160 is driven as shown by chain 171 from the idler sprocket 42 of the main conveyor means 14 for intermittent rotation in the counter-clockwise direction as seen in FIG. 1, thus insuring that the spiked chains 158 and 159 are in exact synchronization with the driven movement of the main conveyor chains 34 and 36. When so driven, the spiked chains 158 and 159 are respectively effective to pierce and grasp the respective opposite edges of the film 150 to unwind the same from the roll and advance the film over the advancing substrates 102 substantially in the area of idler sprocket 168 as seen in FIG. 1.

The film heater means 22 comprise a heater box 170 which is supported as shown, with freedom for vertical movement, from main frame 12 by a heater box frame 172 which comprises spaced, vertical tracks 174, 176, 178 and 180, respectively. A plurality of guide and tracking wheels, only four of which are illustrated as indicated at 182, 184, 186 and 188 in FIG. 2, cooperate with the heater box 170 and heater box frame 172 to guide the vertical movement of the former relative to the latter. A reversible gear motor and worm drive gear box are indicated at 190 and 192, respectively, and are supported as shown atop the heater box frame 172. A heater box elevating screw 194 extends between gear box 192 and a worm gear box 196 which is carried from the heater box 170; it being clear to those skilled in this art that driven rotation of screw 194 by motor 190 under control of control console means 33 will be effective to raise or lower the heater box in accordance with the direction of such rotation. A heat sensor is indicated schematically at 198 in FIG. 1 and is operative, either directly or through control console means 33, to automatically control the operation of heater box drive motor 190 and thus the elevation of the heater box 170 above the film 151. This would be of particular advantage to prevent excessive film heating in instances, as described hereinabove, wherein an additional dwell period is provided; and will, in any event, at all times function to maintain the operational cycle of the apparatus 10 on hold until the film 151 has been heated to the correct predetermined temperature thus insuring against premature article packaging operation. Also, motor 190 is controlled from console means 33 to automatically raise the heater box 170 to its uppermost position upon shut-down of the apparatus 10.

Preferably the heater box will comprise radiant heat panels or the like which are zoned and controlled by control console means 33 to provide three, respectively uniform film heating zones as indicated generally at H1, H2 and H3 in FIG. 2; with zones H1 functioning to heat the outer edges of the film 151 at the front lead in thereof beneath the heater box, zone H2 functioning to heat the film center at that lead in, and zone H3 functioning to heat the area of the film over the film pressure forming means 24. Preferably, appropriate heating zone temperature controls are provided in the apparatus control console means 33 for individual control of the respective temperatures of film heating zones H1, H2 and H3. For a typical application of the apparatus 10, zone Hl would be at the highest temperature, zone H2 at the next highest temperature, and zone H3 at the lowest temperature. Louvers as indicated at 199 in FIG. 1 may be provided in the walls of the heater box 170 if and as required.

The film pressure forming means 24 comprise a vertically movable, generally rectangular open vacuum clamp 200 (FIG. 1) which is supported at opposite edges from and operated as shown by a single, main frame supported pneumatic actuating cylinder 202, cylinder piston rod 204, pivotally connected lever arms 206, and pivotally connected clamp support shafts 208, respectively. The actuating cylinder 202 is controlled as indicated by solenoid operated valve means as schematically depicted at 209 from the control switch means 32. The vacuum clamp 200 may, for example, generally take the form of that depicted at FIG. 7 of U.S. Pat. No. 4,064,676, the disclosure of which is hereby incorporated by reference herein. A safety limit switch is indicated schematically at 211 and is carried as shown from the lower surface of the vacuum clamp 200. Limit switch 209 is connected in series with the control console means 33 and is effective when actuated, for example by contact of a removeable, vacuum clamp-carried grid—which conforms with the configuration of the die cutting means 28—with a misaligned article on a substrate, to immediately shut off the apparatus 10 thus preventing subsequent damage by that article to the die cutting means 28. Alternatively, a solid state memory control circuit could be operatively incorporated in the control console means 33 and keyed by limit switch 209, upon sensing of a misplaced article, to allow the apparatus 10 to continue to operate without operation of the die cutting means 28 for the next cycle, thereby saving the apparatus downtime which would otherwise be required to correct the misaligned article.

A generally rectangular, perforated vacuum platen is indicated at 210 and takes the place of the conveyor platen 47 at the area of the film pressure forming means 24. The platen 210 is operatively associated as shown with a main frame-supported sealed vacuum chamber 212 utilizing an appropriately configured, internal sliding sealed plate which is vertically movable in the chamber 212, through appropriate connection to a pneumatic actuating cylinder 214, to create and precisely control the proper vacuum without the necessity for complex and expensive vacuum pump and reserve means, and associated electrical components. The pneumatic cylinder 214 is operated as indicated from main control switch means 32 by solenoid operated valve means as schematically illustrated at 215. With the vacuum clamp 200, the vacuum platen 210 and the vacuum chamber 212 relatively arranged and respectively operable as described, it will be clear to those skilled in this art that appropriately timed operation of the actuating cylinders 202 and 214 as directed by main control switch means 32 will be effective to draw the plastically heated film 151 down into close fitting contact with the article and the porous substrate 102 upon which the article is carried, and to clamp and bond the heated film to the respective substrate edges, thus effectively skin packaging the article thereon.

The film cooling means 26 comprise an air knife 216 which is supported from and extends transversely of the main frame 12 as shown, and which is effective to direct cool air from any convenient, non-illustrated source downwardly onto the surface of the film 151 to cool the same over the article-substrate package. A solenoid operated valve as schematically illustrated at 217 in FIG. 1 controls the operation of air knife 216 from control switch means 32. For those article packaging applications of the apparatus 10 wherein contact by the heated film 151 with the ambient air downstream of the heater box 170 is sufficient to effect film cooling, the air knife 216 may be eliminated or rendered inoperative.

The film and substrate die cutting means 28 comprise a steel rule cutting die 218 and die platen 219 which are carried in a toggle die press 220 for actuation by a fluidic actuating cylinder 222. The toggle die press 220 may, for example, take the general form of that disclosed in U.S. Pat. No. 4,064,676, cited supra. The actuating cylinder 222 is controlled by a solenoid operated control valve, as schematically depicted at 224, which is in turn controlled as indicated from main control switch means 32. Locking channel clamps are indicated at 225 and are included as shown in the die press 220 to enable rapid and convenient cutting die changeover. Although not shown, it may be understood that a locating aperture is provided through the cutting die platen 219; whereupon, with the cutting die 218 properly positioned, the latter may be drilled through with an aligned aperture and a locating pin disposed therein for easy cutting die relocation. On command from the main control switch means, the cutting die 218 is effective to cut the bonded film-substrate package to the desired shape(s) and size(s) around the film-packaged article(s). Preferably, the rule dies 218 are deliberately nicked to carry the die cut packaged articles, and the skeletal film waste, out from under the die press for output delivery.

The skin packaged article finishing and collection means 30 comprise nip wheels 226 and 228 (FIGS. 1 and 2) which are supported for rotation with shaft 230 from main frame 12. The nip wheels are drivingly and synchronously rotated from conveyor sprocket 44 by drive belt 232 (FIG. 1), and function when so rotated, to grasp the respective, skin packaged substrate edges and pull the same through to a delivery table 234 after the pusher lugs 46 on the conveyor chains 34 and 36 drop below the conveyor platen 47 upon rounding the drive sprocket 44 and lose contact with the substrates.

A traveling razor knife is indicated at 236, and is supported from and operated by pneumatic actuating cylinder 238 which is in turn supported as shown from main frame 12. The actuating cylinder 238 is controlled as indicated from main control switch means 32 by a solenoid operated control valve as schematically indicated at 240 in FIG. 2. Upon actuation, the traveling razor knife is effective to sever the film to separate the skeletal waste of the substrate and film.

Further included in the finishing and collection means 30 is a packaged article sweeping mechanism 242, including sweeping arm 244, which is supported from and operated by a main frame-supported pneumatic actuating cylinder 246. The actuating cylinder 246 is controlled as indicated from main control switch means 32 by a solenoid operated control valve as indicated schematically at 248 in FIG. 2. As the appropriately film and substrate packaged articles, and the skeletal film and substrate waste, drop to the delivery table 234, the sweeping mechanism 242 is actuated with the result that sweeping arm 244 sweeps the same across the table 234 to the safe exposed table area 250 for separation of the skeletal waste and boxing of the packaged articles by an operator. Safety stop switches 252 and 253 (FIG. 1) are carried as shown from the main frame 12 at the areas of the substrate feeder means 18 and the delivery table area 250, respectively, so as to be immediately accessible to the operators at opposite ends of the apparatus 10 for the starting and stopping of the same at will. This would be of particular importance in the event of a safety hazard or malfunction in the finishing and collection operations. With further regard to safety, it may be understood that a suitable, readily removeable material such as wire mesh or plexiglass, as indicated in fragmentary fashion at 264 in FIG. 1 is supported from main frame 12 to shield the moving parts of the apparatus 10 from the sides to prevent operator injury.

The main timing control switch means 32 may, for example, take the form of a multi, split cam automatic timing and control switch as manufactured by Automatic Timing And Controls Co. of King of Prussia, Penna. Switches of this nature comprise a plurality of switch-operating split cams, each side of which is readily and precisely adjustable, in either direction through use for example of a simple screwdriver. In a typical configuration, the left side of each of the split cams determines the precise instant during controlled apparatus operation at which the cam-operated switch will be actuated while the right side of each of the cams determines the precise duration of such switch actuation. For use in the apparatus 10 of my invention as described, the switch means 32 would be driven and timed from the main conveyor drive means as by flexible cable 49 (FIG. 4) and would comprise seven split cams, as respectively schematically indicated at J, K, L, M, N, O and P in FIG. 1 of the drawings. In such instance, split cam J would control the automatic card feeder 18 through actuating cylinder 112 and valve 113, split cam K would control the vacuum clamp 200 through actuating cylinder 202 and valve 209, split cam L would control the vacuum chamber 212 through actuating cylinder 214 and valve 215, split cam M would control the air knife 216 through valve 217, split cam N would control the die press 220 through actuating cylinder 222 and valve 224, split cam O would control the razor knife 236 through actuating cylinder 238 and valve 240, and split cam P would control the sweeping mechanism 242 through actuating cylinder 246 and valve 248, respectively. Thus, the instant at which each of those apparatus components operates, and the duration of such operation, for each cycle of the apparatus, are respectively precisely controlled and coordinated to result in maximum overall efficiency and effectiveness of operation of the apparatus 10.

The apparatus control console means 33 comprise a console 254 which is conveniently and safely disposed on main frame 12 to extend therefrom as best seen in FIG. 2 well away from any and all moving parts of the apparatus 10. The console 254 includes all control switches and monitoring instruments and the like, as generally indicated at 256 in FIG. 2, required for operation of the apparatus 10. Preferably, all electrical components in the control console are of solid state configuration to maximize reliability.

Referring to the lettered operational stations of FIG. 1 to summarize the operation of the apparatus 10 regarding a single substrate, it will now be clear to those skilled in this art that as an article-bearing substrate 102 is advanced by the conveyor means 14 to station A-B, the film supply and feeder means 20 and film heater means 22 will operate to advance and heat an appropriate length of the film 151 for application thereto. Subsequent substrate advancement by the conveyor means to station B-C will result in further heating of the film and the pressing thereof over the article and substrate for film bonding to the article and substrate by film pressure forming means 24. The next advancement of the substrate in question will place the same at station C-D for cooling of the film by the film cooling means 26; as followed, after an appropriate delay, by substrate advancement to station D-E for die cutting of the film and substrate into pluralities of the latter by die cutting means 28. Subsequent advancement of the substrates to station E-F results in the severing of the film to separate the substrate-packaged articles by the razor knife means 236; while the final advancement of the substrates by the nip wheels 226 and 228 to station F-G enables the sweeping thereof, and of the skeletal film waste, by the sweeping mechanism 242 to the delivery table area 250 for appropriate disposal of the skeletal waste and collection of the appropriately skin packaged articles by the operator. Of course, operation as described at the various stations is concomitant until all of the articles to be packaged have been accommodated.

By all of the above is believed made clear that the new and improved skin packaging apparatus of my invention will function in full accordance with the heretofore stated objects thereof to provide for maximal article packaging rates commensurate with the capabilities of the apparatus operator(s), high and consistent precision of skin-packaging operation, relatively simple and economical apparatus design and construction, low apparatus maintenance requirements, maximal provision for apparatus operator safety, and ready and precise adjustability in the apparatus article packaging rate.

Various changes may, of course, be made in the hereindisclosed preferred embodiment of my invention without departing from the spirit and scope thereof as defined by the appended claims.

What is claimed is:

1. Apparatus for the automatic thermoplastic film packaging of articles on substrates comprising, conveyor means for advancing article-bearing substrates through said apparatus, drive motor means for driving said conveyor means, connecting means operatively connecting said drive motor means to said conveyor means for intermittently advancing said conveyor means in response to the operation of said drive motor means, said drive motor means being rotatable in one direction only, said connecting means comprising overrunning clutch means operatively connected to said conveyor means, and means operatively connected to said drive motor means and said overrunning clutch means and operable in response to the rotation of said drive motor means to rotate said overrunning clutch means in two directions, said overrunning clutch means being operable in turn to advance said conveyor means in response to rotation of said overrunning clutch means in one direction, only.

2. In apparatus as in claim 1 wherein, said drive motor means are constantly operable during operation of the apparatus.

3. In apparatus as in claim 1 further comprising, stop means operatively associated with said conveyor means and operable to positively stop conveyor means advancement at substantially the same conveyor means location at the end of each conveyor means advance.

4. In apparatus as in claim 1 wherein, said drive motor means are rotatable at constant velocity, and are constantly operable during operation of the apparatus.

5. In apparatus as in claim 1 wherein, said means operatively connected to said drive motor means and said overrunning clutch means comprise, crank means rotated by said drive motor means, rack gear means reciprocated by said crank means, and pinion gear means rotated by said rack gear means in both directions attendant the reciprocation of the latter and operatively connected to said overrunning clutch means to rotate the same accordingly.

6. Apparatus for the automatic thermoplastic film packaging of articles on substrates comprising, conveyor means for advancing article-bearing substrates through said apparatus, drive motor means for driving said conveyor means, connecting means operatively connecting said drive motor means to said conveyor means for intermittently advancing said conveyor means in response to the operation of said drive motor means, said connecting means comprising means for advancing said conveyor means during predetermined periods, only, of the operation of said drive motor means, and stop means operatively associated with said conveyor means and operable to positively stop conveyor means advancement at substantially the same conveyor means location at the end of each conveyor means advance.

7. In apparatus as in claim 6 further comprising, substrate feeder means operatively associated with said conveyor means and operable to automatically feed the substrates to the conveyor means in the periods between conveyor means advancements.

8. In apparatus as in claim 6 wherein, said drive motor means are rotatable, and are constantly operable during operation of the apparatus.

9. In apparatus as in claim 6 further comprising, thermoplastic film supply means operatively associated with said conveyor means and operable to supply film over said article-bearing substrates on said conveyor means for bonding to the substrates, film heater means operatively associated with said conveyor means and operative to heat the thusly supplied film, and pressure forming means operatively associated with said conveyor means for pressing the thusly supplied and heated film to the article-bearing substrates, said pressure forming means comprising a vacuum clamp disposed above the film and article-bearing substrates and being vertically moveable into contact therewith, vacuum platen means disposed below the article-bearing substrates in substantial alignment with said vacuum clamp means, and vacuum chamber means enclosed by said vacuum platen and operable to draw a vacuum therethrough to draw the film against the article-bearing substrates.

10. Apparatus as in claim 9 further comprising, die cutting means operatively associated with said conveyor means and being vertically moveable into contact with said film covered article-bearing substrates to cut the same, detecting means operatively connected to said vacuum clamp and operable to detect misplaced articles on said substrates, and control means operatively connected to said detecting means and said die cutting means and operable to discontinue operation of the latter in the event of misplaced article detection without discontinuing operation of said conveyor drive means.

11. In apparatus as in claim 6 wherein, said connecting means comprise means enabling slippage as required between said drive motor means and said conveyor means upon operation of said stop means at the end of each conveyor means advancement.

12. In apparatus as in claim 6 wherein, said connecting means futher comprise, slip clutch means operable to determine the maximum amount of driving force which may be applied from said drive motor means to said conveyor means to thereby enable slippage as required between said drive motor means and said conveyor means upon operation of said stop means.

13. In apparatus as in claim 6 wherein, said connecting means comprise, means for advancing said conveyor means at different advance velocities attendant each conveyor means advancement, means for smoothly accelerating said conveyor means from rest to maximum conveyor means advance velocity attendant substantially the first half of each conveyor means advancement, and means for smoothly deccelerating said conveyor means from maximum conveyor means advance velocity back to rest attendant substantially the second half of each said conveyor means advancement.

14. In apparatus as in claim 6 wherein, said stop means are adjustable relative to said conveyor means, thereby enabling adjustment in the conveyor means location at which the same are stopped at the end of each conveyor means advance.

15. In apparatus as in claim 12 wherein, said slip clutch means are adjustable relative to said conveyor means, thereby enabling adjustment in the maximum amount of driving force which may be applied from said drive motor means to said conveyor means.

16. Apparatus for the automatic thermoplastic film packaging of articles on substrates comprising, conveyor means for advancing article-bearing substrates through said apparatus, drive motor means for driving said conveyor means, connecting means operatively connecting said drive motor means to said conveyor means for intermittently advancing said conveyor means in response to the operation of said drive motor means, said connecting means comprising means for advancing said conveyor means during predetermined periods, only, of the operation of said drive motor means, thermoplastic film supply means and film heater means operatively associated with said conveyor means, said film supply means being operable to supply film over said article-bearing substrates on said conveyor means for bonding to the substrates, said film heater means being disposed above the thusly supplied film to heat the same and being vertically moveable relative thereto, and means operatively connected to said film heater means and operable in response to the temperature of said film to vertically move said film heater means relative to said film in synchronism with film movement to adjust the extent of film heating.

17. Apparatus as in claim 16 further comprising, control means operatively connected to said conveyor drive means and said film heater operating means and operable to delay conveyor means advance until said film has been heated to a predetermined temperature.

* * * * *